US006913179B1

(12) United States Patent
Chen

(10) Patent No.: US 6,913,179 B1
(45) Date of Patent: Jul. 5, 2005

(54) SAFETY DEVICE FOR LOCKING THE SAFETY BAR OF PNEUMATIC NAILERS

(75) Inventor: Ming Hsien Chen, Taichung (TW)

(73) Assignee: Nailermate Enterprise Corporation, Taipei (TW)

( * ) Notice: Subject to any disclaimer, the term of this patent is extended or adjusted under 35 U.S.C. 154(b) by 0 days.

(21) Appl. No.: 10/763,145

(22) Filed: Jan. 21, 2004

(51) Int. Cl.[7] ..... B27F 7/17
(52) U.S. Cl. ..... 227/8; 227/120; 227/130
(58) Field of Search ..... 227/8, 120, 130

(56) References Cited

U.S. PATENT DOCUMENTS 4,197,974 A * 4/1980 Morton et al. ..... 227/8
4,597,517 A * 7/1986 Wagdy ..... 227/8
5,180,091 A * 1/1993 Ota ..... 227/8
5,551,621 A * 9/1996 Vallee ..... 227/8
5,593,079 A * 1/1997 Mukoyama et al. ..... 227/8
6,199,739 B1 * 3/2001 Mukoyama et al. ..... 227/8
6,264,085 B1 * 7/2001 Ho et al. ..... 227/8
6,267,284 B1 * 7/2001 Clark ..... 227/8
6,422,447 B1 * 7/2002 White et al. ..... 227/120
6,672,497 B2 * 1/2004 Lin ..... 227/8
6,708,860 B1 * 3/2004 Thieleke ..... 227/8

* cited by examiner

*Primary Examiner*—Scott A. Smith
*Assistant Examiner*—Brian Nash
(74) *Attorney, Agent, or Firm*—Charles E. Baxley

(57) ABSTRACT

A safety device for a pneumatic nailer includes an attached tube connected to the magazine of the nailer and including a first passage for movably receiving a first pine and a second passage for movably receiving a second pin. A driving piece is pivotably connected to the attached tube at a mediated point of the driving piece. A spring is received in the second passage and biased between a closed end of the second passage and a first end of the second pin. A second end of the second pin is retractably extended through an open end of the second passage by the spring and can be inserted in a locking hole of a safety bar movably connected to the barrel of the nailer. Two ends of the driving piece are respectively connected to the first pin and the second pin such that when no nails are located in the barrel, an end of the first pin is extended into the magazine while the second pin is inserted in the locking hole of the safety bar to lock the safety bar.

3 Claims, 3 Drawing Sheets

SAFETY DEVICE FOR LOCKING THE SAFETY BAR OF PNEUMATIC NAILERS

FIELD OF THE INVENTION

The present invention relates to a safety device which locks the safety bar of a pneumatic nailer when no nails in the barrel.

BACKGROUND OF THE INVENTION

A conventional pneumatic nailer generally includes a body with a barrel which is connected to a magazine in which nails are received. The nails are urged by a spring so as to be pushed into the barrel to be fired by an impact pin which is driven by pneumatic power. A safety bar is movably connected to the nailer and connected to a trigger mechanism such that the trigger can be pulled to fire the nails only when the safety bar is pushed against the object to be nailed. The safety bar effectively reduces risks of unintentional activation of the trigger mechanism. Nevertheless, the safety bar does not have any locking device to prevent it from being pushed even when there is not a nail in the barrel. Under this circumstance, if the safety bar is pushed, the trigger mechanism can be activated although no nail is ejected from the barrel. The impact pin moves by the pneumatic power and could hit the surface of the object to which the safety bar pushes against. This could damage the impact pin and/or the surface of the object.

The present invention intends to provide a safety device that has a pin urged by a spring and the pin locks the safety bar when no nail is located in the barrel such that the safety pin cannot be pushed backward.

SUMMARY OF THE INVENTION

The present invention relates to a safety device of a pneumatic nailer. The pneumatic nailer includes a barrel having a through passage and a magazine is connected to the barrel so as to provide nails into the through passage. A safety bar is movably connected to the barrel and has a locking hole defined therethrough.

An attached tube is connected to an outside of the magazine and includes a first passage for movably receiving a first pin therein and a second passage for movably receiving a second pin therein. A communication slot is in communication between the first passage and the second passage. The first passage includes an opening which communicates with the receiving path such that an end of the first pin may extend into the receiving path. A spring is received in the second passage and biased between a closed end of the second passage and a first end of the second pin. A second end of the second pin is retractably extended through an open end of the second passage by the spring and may be inserted in a locking hole of a safety bar which is movably connected to the barrel. A driving piece is received in the communication slot and pivotably connected to the attached tube at a mediated point of the driving piece. Two ends of the driving piece are respectively connected to the first pin and the second pin such that the first pin and the second pin are moved in opposite directions. The end of the first pin extends into the receiving path of the magazine when no nails are in the barrel, and the second end of the second pin is inserted into the locking hole of the safety bar.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
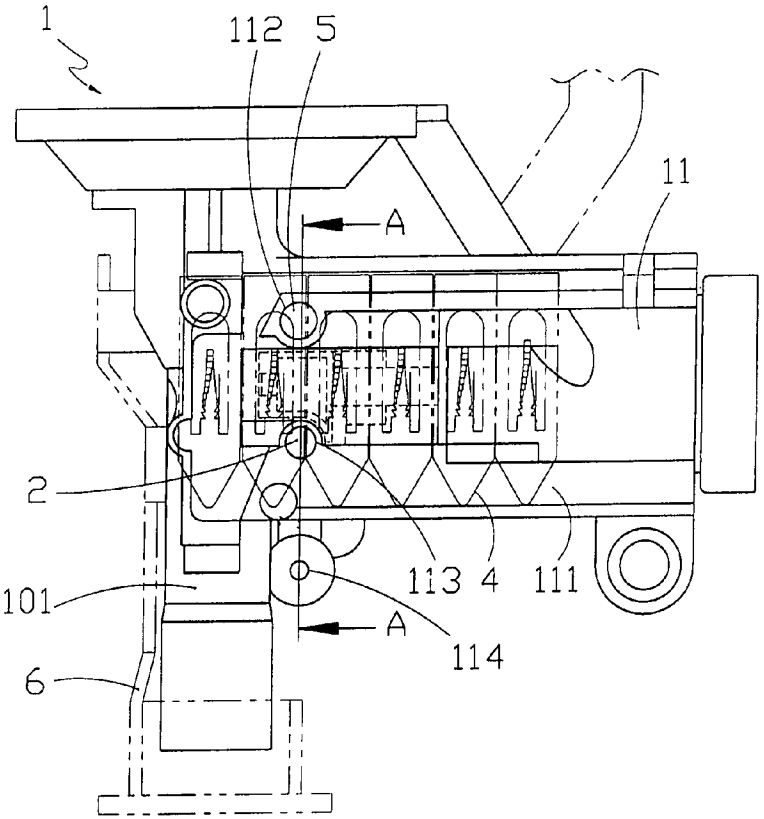
FIG. 2 shows nails in the magazine connected to the barrel and the position of the magnetic member in the magazine.
Figure 1:
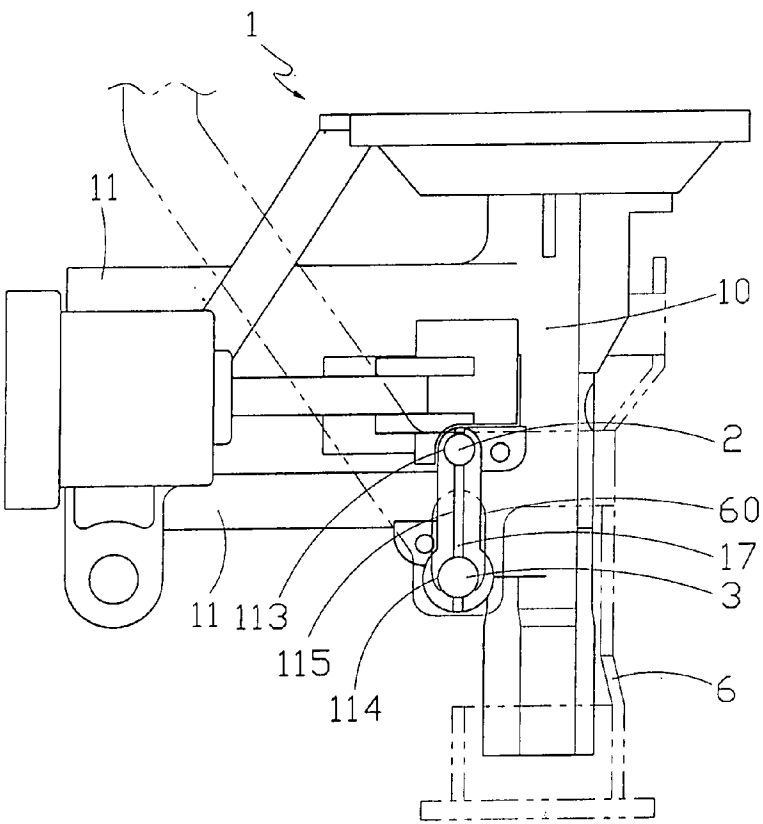
FIG. 1 shows the attached tube on the magazine of the nailer and a safety bar is movably connected to the barrel of the nailer.

Referring to FIGS. 1 and 2, the pneumatic nailer 1 includes a barrel 10 having a through passage 101 defined therethrough and a magazine 11 is connected to the barrel 10. The magazine 11 has a receiving path 111 for receiving nails 4 therein and the receiving path 111 communicates with the through passage 101 in the barrel 10 such that the nails are provided into the through passage 101 to be ejected by an impact pin which is not shown. The magazine 11 includes a recess 112 (FIG. 3) defined in an inside thereof and a magnetic member 5 is received in the recess 112 so that the magnetic member 5 attracts the nails 4 to desired position. A safety bar 6 is movably connected to the barrel 10 and has a locking hole 60 defined therethrough. The safety bar 6 can be pushed backward and against an object to be nailed so as to activate a locking device in a trigger mechanism. The trigger mechanism can be pulled only when the locking device in the trigger mechanism is unlocked.

Figure 5:
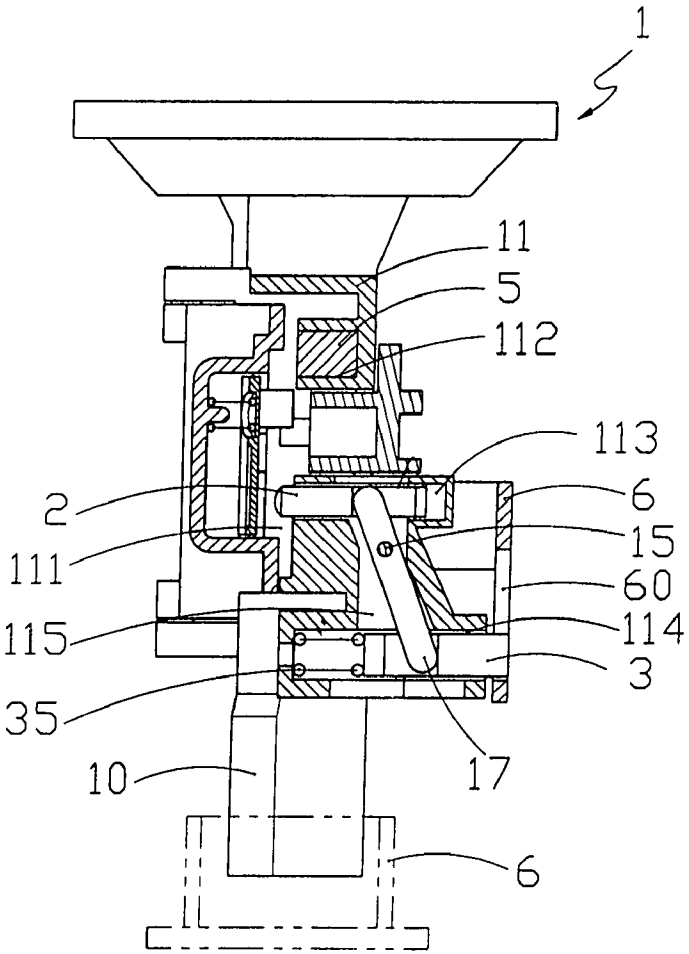
FIG. 5 is a cross sectional view taken by B—B line.
Figure 3:
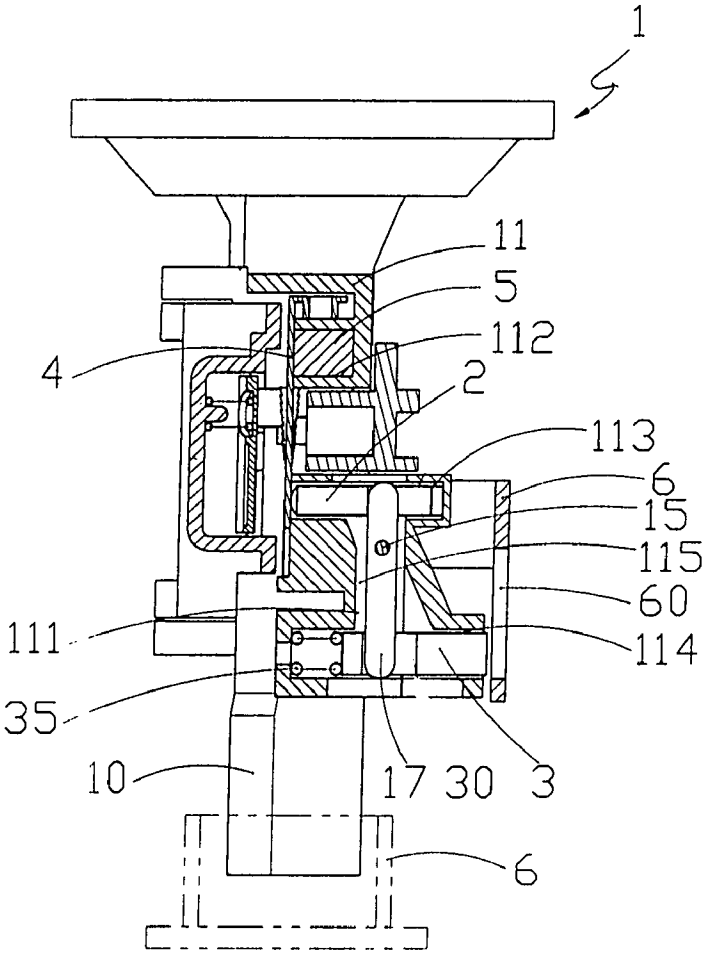
FIG. 3 is a cross sectional view taken by A—A line.
Figure 4:
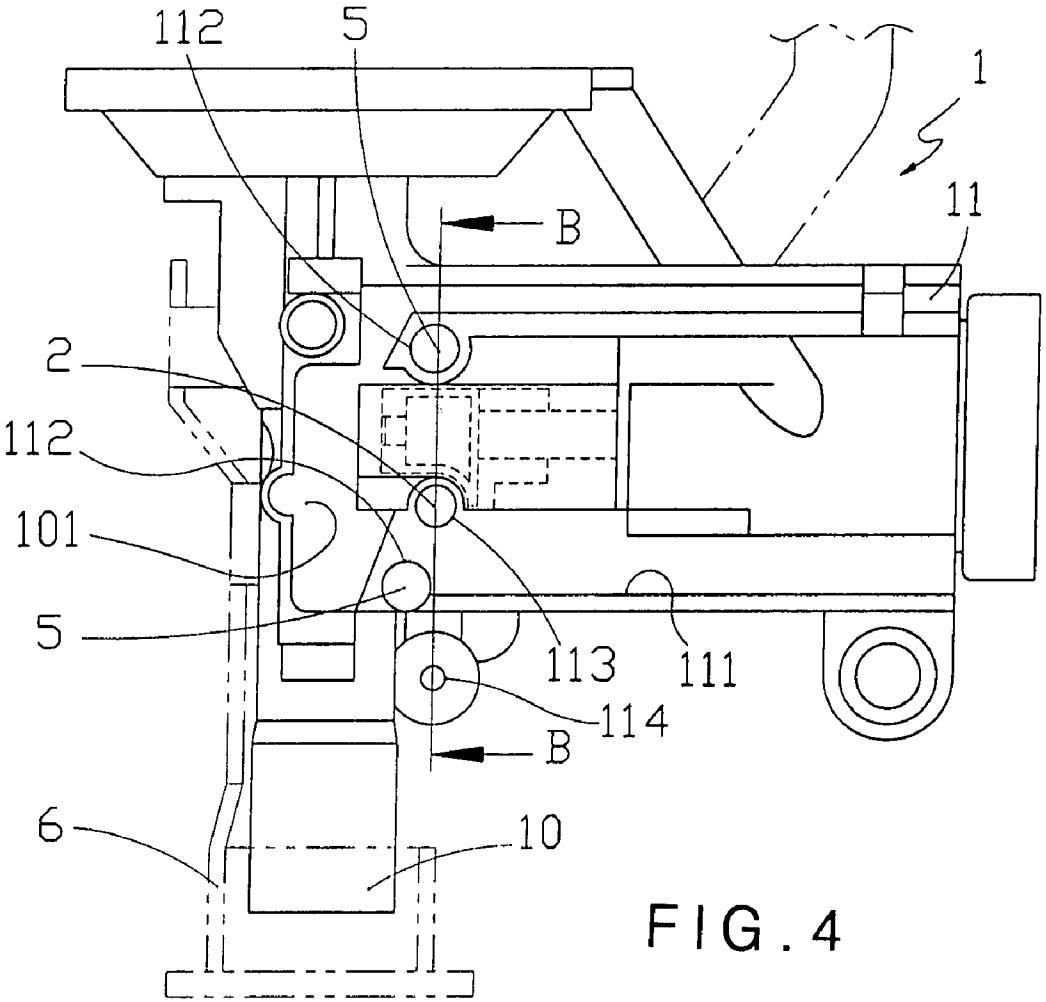
FIG. 4 shows that no nails are received in the magazine and the barrel.

Referring to FIGS. 3 to 5, an attached tube is connected to an outside of the magazine 11 and includes a first passage 113 and a second passage 114. A communication slot 115 is in communication between the first passage 113 and the second passage 114. The first passage 113 includes an opening which communicates with the receiving path 111. A first pin 2 is movably received in the first passage 113 and a second pin 3 is movably received in the second passage 114. A spring 35 is received in the second passage 114 and biased between a closed end of the second passage 114 and a first end of the second pin 3. A driving piece 17 is received in the communication slot 115 and pivotably connected to the attached tube at a mediated point of the driving piece 7. Two ends of the driving piece 17 are respectively and pivotably connected to the first pin 2 and the second pin 3 such that the first pin 2 and the second pin 3 are moved in opposite directions. An open end of the second passage 114 communicates with the locking hole 60 of the safety bar 6.

When there are nails 4 in the magazine 11 as shown in FIGS. 2 and 3, the nails 4 are attracted by the magnetic member 5 and close the opening of the first passage 113. The left end of the first pin 2 is then stopped by the nails 4 and cannot move to its extreme left position as shown in FIG. 5. The driving piece 17 is then located upright as shown in FIG. 3 because the first pin 2 is pushed toward the right by the nails 4, and the position of the first pin 2 makes the driving piece 7 to compress the spring 35 and pulls a second end of the second pin 3 to be retracted and the second end of the second pin 3 is retracted from the locking hole 60 of the safety bar 6. Therefore, the safety bar 6 can be pushed backward against an object to be nailed.

As shown in FIGS. 4 and 5, when no nails 4 are located in the magazine 11 and the barrel 10, the left end of the first pin 2 extends into the receiving path 111 of the magazine 11 to its extreme left position and the second pin 3 is pushed by the spring 35 so that the second end of the second pin 3 is inserted into the locking hole 60 of the safety bar 6. Therefore, the safety bar 6 is limited from being pushed backward.

While we have shown and described the embodiment in accordance with the present invention, it should be clear to those skilled in the art that further embodiments may be made without departing from the scope of the present invention.

What is claimed is:

1. A combination of a safety device and a pneumatic nailer, wherein the pneumatic nailer includes a barrel having a through passage defined therethrough and a magazine is connected to the barrel, the magazine has a receiving path for receiving nails therein and the receiving path communicates with the through passage in the barrel, a safety bar movably connected to the barrel and has a locking hole defined therethrough, and an attached tube connected to an outside of the magazine and includes a first passage and a second passage, the first passage includes an opening which communicates with the receiving path, a first pin is movably received in the first passage and a second pin is movably received in the second passage, a spring is received in the second passage and biased between a closed end of the second passage and a first end of the second pin, a second end of the second pin is retractably extended through an open end of the second passage by the spring, the open end of the second passage communicates with the locking hole of the safety bar, a driving piece is pivotably connected to the attached tube at a mediated point of the driving piece, two ends of the driving piece are respectively connected to the first pin and the second pin such that the first pin and the second pin are moved in opposite directions, an end of the first pin extends into the receiving path of the magazine and is adapted to be stopped by the nails to limit the second end of the second pin from being inserted into the locking hole of the safety bar.

2. The combination as claimed in claim 1, wherein the magazine includes a recess defined in an inside thereof and a magnetic member is received in the recess, the magnetic member is adapted to attract the nails to close the opening of the first passage.

3. The combination as claimed in claim 1 further comprising a communication slot defined in communication between the first passage and the second passage, the driving piece being pivotably received in the communication slot.

* * * * *